US005277419A

United States Patent [19]

Craig

[11] Patent Number: 5,277,419

[45] Date of Patent: Jan. 11, 1994

[54] METHOD OF PLAYING A THREE DIMENSIONAL GAME

[75] Inventor: Paul Craig, Rancho Palos Verdes, Calif.

[73] Assignee: Lee W. Tower, Rancho Palos Verdes, Calif. ; a part interest

[21] Appl. No.: 950,117

[22] Filed: Sep. 23, 1992

[51] Int. Cl.[5] ..... A63F 3/00

[52] U.S. Cl. ..... 273/241; 273/271

[58] Field of Search ..... 273/271, 241, 240

[56] References Cited

U.S. PATENT DOCUMENTS

| | | | |
|---|---|---|---|
| 2,313,473 | 9/1943 | Heacock et al. | 273/241 |
| 4,813,681 | 3/1989 | Volpert | 273/271 |
| 4,884,816 | 12/1989 | Ford et al. | 273/240 |

FOREIGN PATENT DOCUMENTS

| | | | |
|---|---|---|---|
| 21253 | of 1902 | United Kingdom | 273/271 |
| 1109204 | 4/1968 | United Kingdom | 273/241 |
| 1160120 | 7/1969 | United Kingdom | 273/241 |

OTHER PUBLICATIONS

Parker Brothers, "Qubic", Jun. 1967.

Creative Playthings Catalog "Orginal Plato Game" p. 73, Oct. 1969.

*Primary Examiner*—Benjamin H. Layno

*Attorney, Agent, or Firm*—Lee W. Tower

[57] ABSTRACT

An improved method for playing a board game consisting of three boards each having 3 rows and 3 columns of squares and the boards stacked on top of one another with each board forming arranged together there are 3 rows by 3 columns by 3 vertical boards for a total of 27 squares. The game is played with two or more players. Each player has a set of normal pieces and a "star piece" distinguishable from the normal pieces. The goal of each player is to be the first to complete the formation of three straight lines each with three two normal pieces and a "star piece" randomly selected. The three straight lines can be diagonal, vertical, or horizontal in any direction. The "star piece" can only be played on the "star point", which is the middle square of the middle board. Another version of the game has four boards with two possible star points, one which is the middle square of the board next to the top board and one which is the middle square of the board next to the bottom board. Each player would have one star piece. There are a number of variants of the game. One would allow any player to play his star piece on either empty star point. Another variant of the game with only two players, would assign one star point to one player and the other star point to the other player.

3 Claims, 9 Drawing Sheets

METHOD OF PLAYING A THREE DIMENSIONAL GAME

BACKGROUND OF THE INVENTION

1. Field of the Invention

This invention relates to the field of entertainment and especially to board games.

2. Prior Art

The prior art has many board games, including chess, checkers, chinese checkers and many more. Tic tac toe is an old game that can be played by two players and is played on a single board which is divided into a matrix with 3 rows and 3 columns. The players take alternate turns placing their pieces in an empty row/column location on the board and the goal for each player is to arrange 3 pieces in a line in any direction, which could be diagonal or along any row or column. Of course, each player also can play defensively to prevent the other player from achieving his goal. If all the rows/-columns have been filled, then no one wins the game and the game is called a "cats game". Tic tac toe is a fairly simple game and normally with two experienced players almost all the games turn into cats games. An inexperienced player can quickly learn tic tac toe and eventually the game becomes boring, because all of the games are cats games; however, tic tac toe remains a favorite game to teach children, because it is easy and quick to play.

A game, similar in some respects to tic tac toe, is quite old and has been recently marketed as "Connect Four" by Milton Bradley Company of Springfield, Mass. In Connect Four, which is also called a vertical checkers game, there are 7 vertical columns that can each hold 6 pieces. The players take turns dropping a piece into one of the seven columns. The first player to connect four of his pieces in a line, whether diagonal, along a horizontal row or a vertical column, wins.

Another game called "Twist Tac Toe" is marketed by Alsip and Company of Bainbridge Island, Wash. and is similar in some respects to tic tac toe. Twist Tac Toe is played with three side by side rotatable spindles that each have three exposed slots within which to put the pieces and additional unexposed slots, that are exposed when a spindle is rotated. The players take turns placing pieces in an exposed slot and choosing whether to turn a spindle. A player wins when 3 exposed slots in a line are filled with his pieces. This game is rather complicated, because it requires the players to remember where his and the other players pieces are located since all of the pieces in the game are not seen at once. Another disadvantage of this game is that the apparatus required to play the game is relatively expensive.

What is needed is a game that can be enjoyed by all who understand the fundamental tic tac toe game, but is more complex so that interest in the game can be sustained. It is also necessary that the game be economical, both in cost and in the time required to learn or to play the game to enable even the hurried in today's world the time to pause for refreshment and enjoy the game. The game should also have an attractive appearance so that it can be left out for spontaneous use, while fulfilling a decorative function. There should also be a factor of chance in the game to increase its appeal. The prior art, as described above, does not incorporate any chance, but only relies on the skill of the players.

SUMMARY OF THE INVENTION

It is an object of the present invention to provide a new method of playing a board game that is fun to play, challenging and attractive in appearance. Another object of the invention is that the rules of the game be easy to learn and that the game be able to be played in a short period of time. Another object of the invention is that the game have an element of chance.

The invention consists of three boards stacked on top of one another with each board divided into 3 rows and 3 columns of squares. When the three boards are stacked on top of one another there are 3 rows by 3 columns by 3 vertical boards for a total of 27 squares. The game is played with two or more players. Each player has a set of pieces, which are identified for that player by color, shape or any other form of identification. The players play their pieces in sequence with the first player playing one piece by placing it on an empty square and then the second player playing one piece and so on and back to the first player who again plays a piece. The goal of each player is to be the first to complete the formation of three lines each with three pieces in a line. Each of the three lines must have three pieces in a straight line, which can be diagonal, vertical, or horizontal in any direction.

Another version of the game has the same arrangement of boards; however, each player, in addition to all the normal pieces, has one piece that is identified as a "star piece". A method is provided whereby each player will randomly select one of his pieces to play on each turn, which will randomize the time at which a player will play a star piece. This method could be as simple as providing a bag for the pieces and having the player shake the bag and without looking taking a piece from the bag, or a special box could be provided which would have a slot through which only one piece could be shaken at a time. The significance of a star piece is that only a star piece can be played on the "star point", which is the middle square of the middle board. The star point is an advantageous place to play because many possible lines of three pieces pass through the star point. The star piece is the only piece that the player can play on the star point, however, the star piece may also be played on any other empty square and if the star point is already occupied by another player's star piece, then if the current player selects a star piece, then it must be played on another empty square. Again, the goal of each player is to be the first to complete the formation of three lines each with three pieces in a line. Each of the three lines must have three pieces in a straight line, which can be diagonal, vertical, or horizontal in any direction. The random selection of the star pieces provides an element of chance to the game, because the first player to select and play a star piece has an advantage; however, the advantage also depends on how early in the game the star piece is selected.

If four boards are used, then the number of possibilities for a player to complete the formation of three lines each with three pieces in a line increases and there are two possible star points, one which is the middle square of the board next to the top board and one which is the middle square of the board next to the bottom board. Again, each player would have one star piece. There are a number of variants of the game. One would allow any player to play his star piece on either empty star point. Another variant of the game with only two players, would assign one star point to one player and the other star point to the other player and the players could only play their star pieces on their assigned star point.

BRIEF DESCRIPTION OF THE DRAWINGS

A better understanding of the invention and its advantages will be apparent from the detailed description taken in conjunction with the accompanying drawings in which.

DESCRIPTION OF THE PREFERRED EMBODIMENTS

Figure 1A:
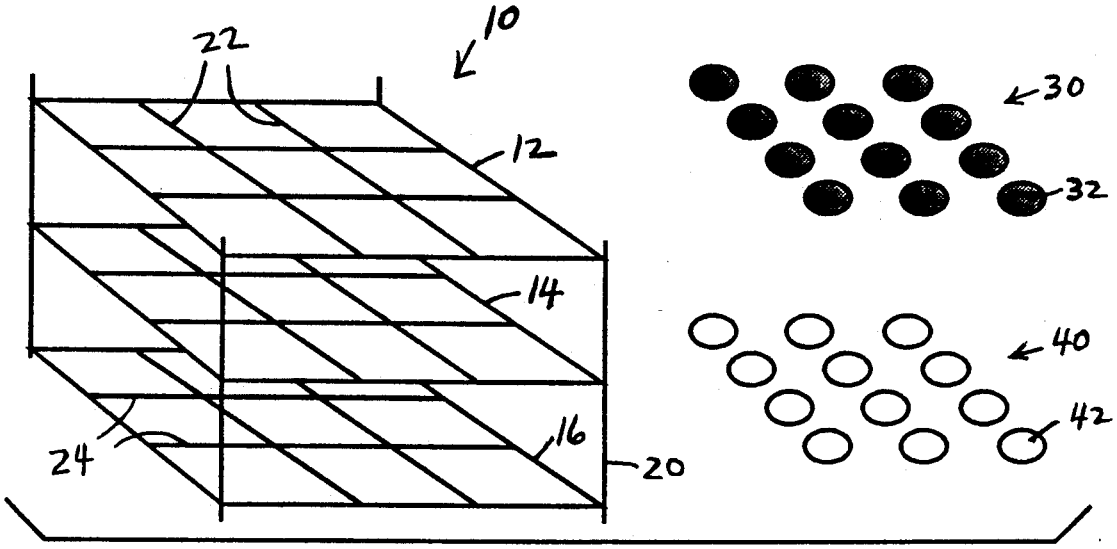
FIG. 1A is a perspective view of the board game and the game pieces according to the present invention.
Figure 1B:
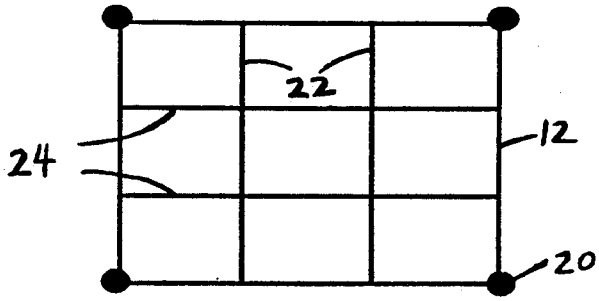
FIG. 1B is a top view of the board game according to the present invention.

Referring now to the drawings, and more particularly, to FIG. 1A, there is shown a three dimensional game 10 of the present invention, which consists of three boards, first board 12, second board 14 and third board 16, stacked on top of one another With each board divided into a matrix of 3 rows and 3 columns. The boards are vertically stacked and supported by supports 20, which can be at the corners of the boards, as shown in FIG. 1, or any other location that supports the vertical spacing of the boards. Each board has a pair of column grid lines 22 and a pair of row grid lines 24, as shown in FIGS. 1A and 1B to divide each board into 9 sections or squares. Normally the boards and the 9 sections would all be square and in this description the sections are described as squares; however, other shapes such as rectangles or rhomboids can also be used. The boards can be made of a transparent material, such as glass or plastic, and the lines scribed into or painted onto the material. The boards can also be made of non-transparent material, although it is more pleasing to be able to see through the boards. Two or more players can play the game; however, for illustration purposes throughout this description it is assumed that there are two players—A and B. Each player has a set of pieces as shown in FIG. 1A with player A having player A pieces 30, with each player A piece represented by player A piece 32, and player B having player B pieces 40, with each player B piece represented by player B piece 42. The pieces for each player are identified by similar colors, shapes or any other form of identification.

Figure 2:
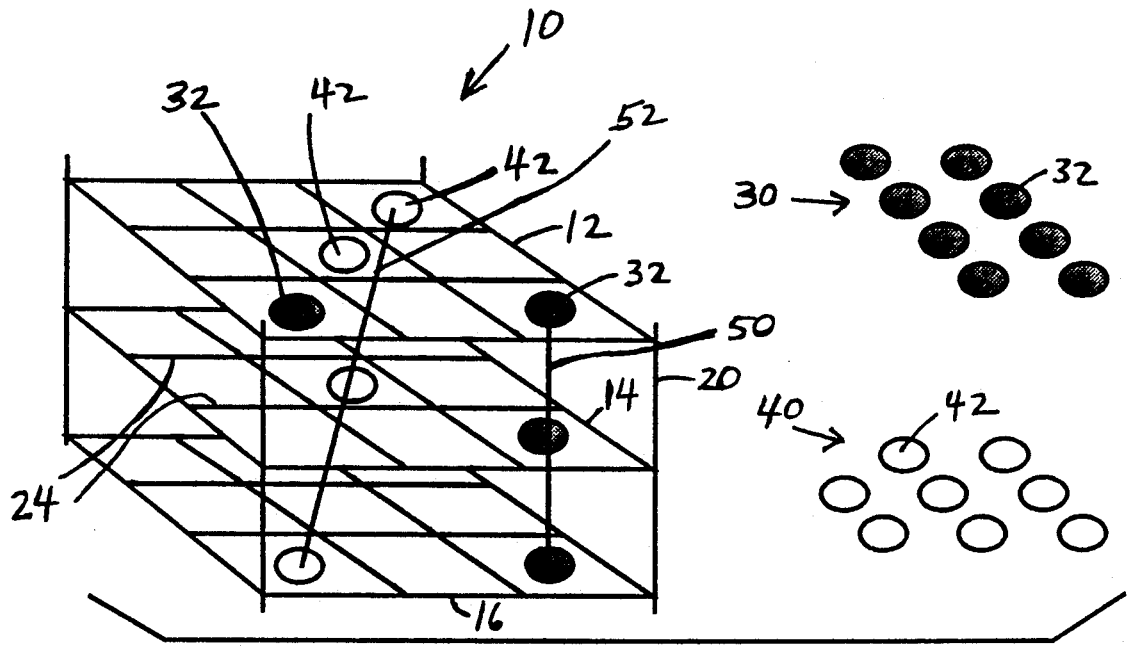
FIG. 2 is a perspective view of the board game and the game pieces according to the present invention after some play has occurred.

The players play their pieces in sequence with the first player playing one piece by placing it on an empty square and then the second player playing one piece and so on and back to the first player who again plays a piece. The goal of each player is to be the first to complete the formation of three lines each with three pieces in a line. Each of the three lines must have three pieces in a straight line, which can be diagonal, vertical, or horizontal in any direction. FIG. 2 shows a partially completed game. Players A and B have each played four pieces and so far there are three player A pieces in a line 50 and three player B pieces in a line 52. Note that on first board 12 player A has blocked a diagonal line which player B started. The game Will continue until either A or B has three completed lines.

Figure 3:
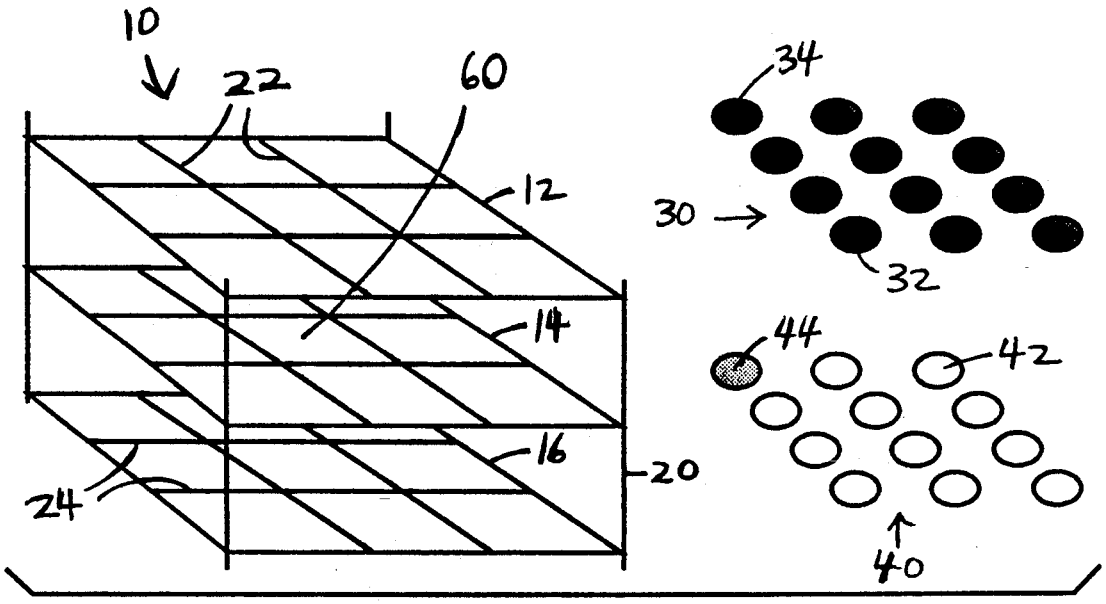
FIG. 3 is a perspective view of the board game with a star point and the game pieces including a star piece for each player according to the present invention.

FIG. 3 shows an alternate perferred embodiment of the game in which the layout of the three boards, first board 12, second board 14 and third board 16, are the same. The only difference is that player A has a player A star piece 34 and player B has a player B star piece 44. These pieces are especially identified for the players and can only be played on star point 60, which is the middle square of the middle board, which is the middle square of second board 14. A method is provided whereby each player will randomly select one of his pieces to play on each turn, which will randomize the time at which a player will select a star piece to play. This method could be as simple as providing a bag for each player's pieces and having a player shake his bag and without looking taking a piece from the bag. Or a special box could be provided to each player, which would have a slot through which only one piece could be shaken at a time.

Figure 5A:
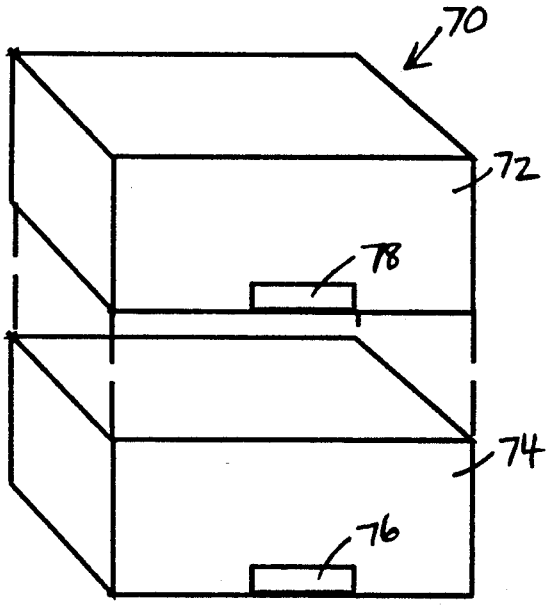
FIGS. 5A and 5B are perspective views of a box design according to the present invention for randomly selecting pieces to play.
Figure 5B:
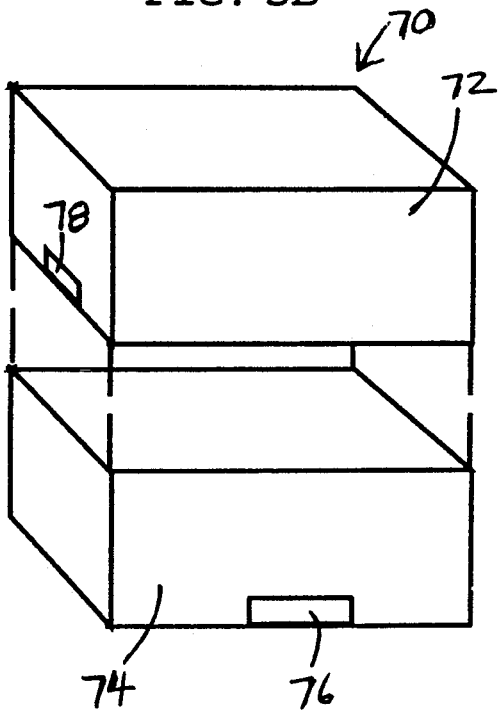
Figure 6A:
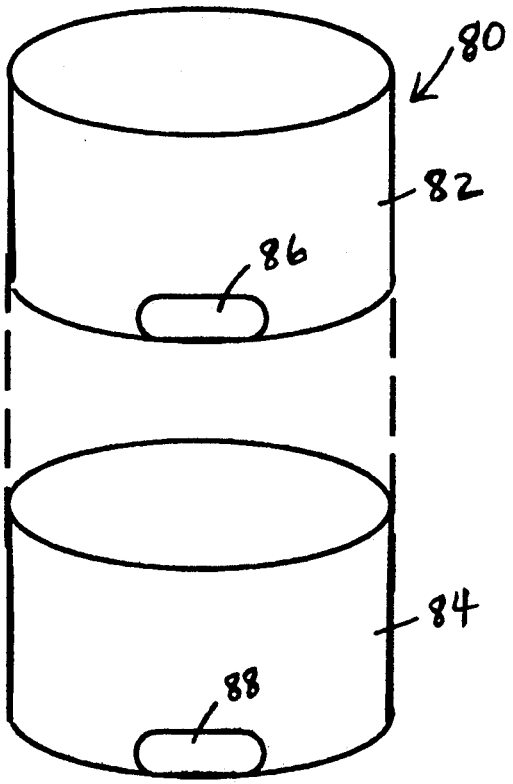
FIGS. 6A and 6B are perspective views of another box design according to the present invention for randomly selecting pieces to play.
Figure 6B:
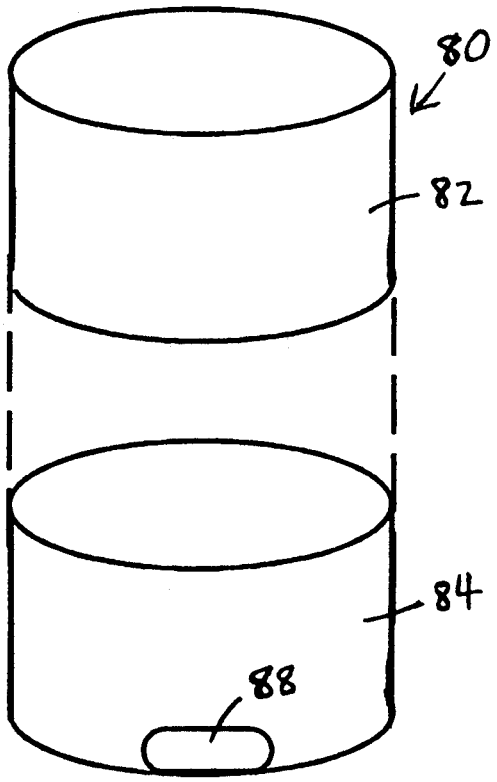

Such a piece box 70 is shown in FIGS. 5A and 5B. The pieces are put into the box bottom 74 which has a bottom slot 76 which is large enough for just one piece to pass through at a time. There is a corresponding box top 72 with a corresponding top slot 78. When the box top 72 is slipped onto box bottom 74 aligned as shown in FIG. 5A, then bottom slot 76 and top slot 78 are aligned and when the box is shaken, one piece can be shaken out of bottom slot 76 at a time. When the box top 72 is rotated relative to box bottom 74 as shown in FIG. 5B, then the slots are not aligned and the piece box 70 can be used to store or transport the pieces without them falling out of bottom slot 76. The boxes can also be round as shown in FIG. 6A and 6B in which a round piece box 80 is formed from a box top 82 with a top slot 86 and a box bottom 84 with a bottom slot 88. To shake pieces out of the box the player would align the slots as shown in FIG. 6A and for storage or transportation of the pieces the player would rotate the box top 82 so that the slots are not aligned, as shown in FIG. 6B.

Figure 7A:
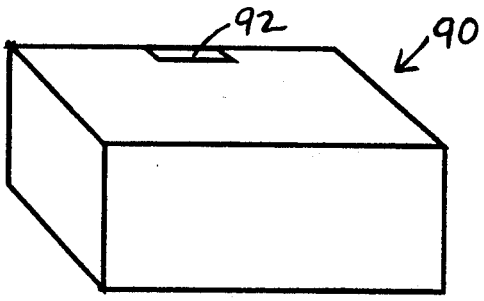
FIGS. 7A, 7B and 7C are perspective views of other box designs according to the present invention for randomly selecting pieces to play.
Figure 7B:
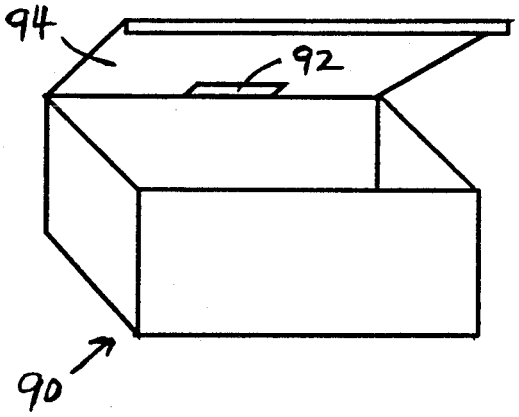
Figure 7C:
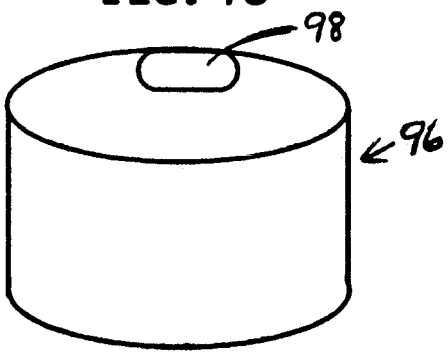

Another embodiment of a box for selecting pieces is piece box 90, as shown in FIG. 7A. Here there is a slot 92 in the box lid 94, which is large enough to allow one piece to be shaken out of the box at a time. FIG. 7B shows the piece box 90 with the box lid 94 open. The boxes can also be round as shown in FIG. 7C, which shows a round piece box 96 with a slot 98 in the lid.

Figure 4:
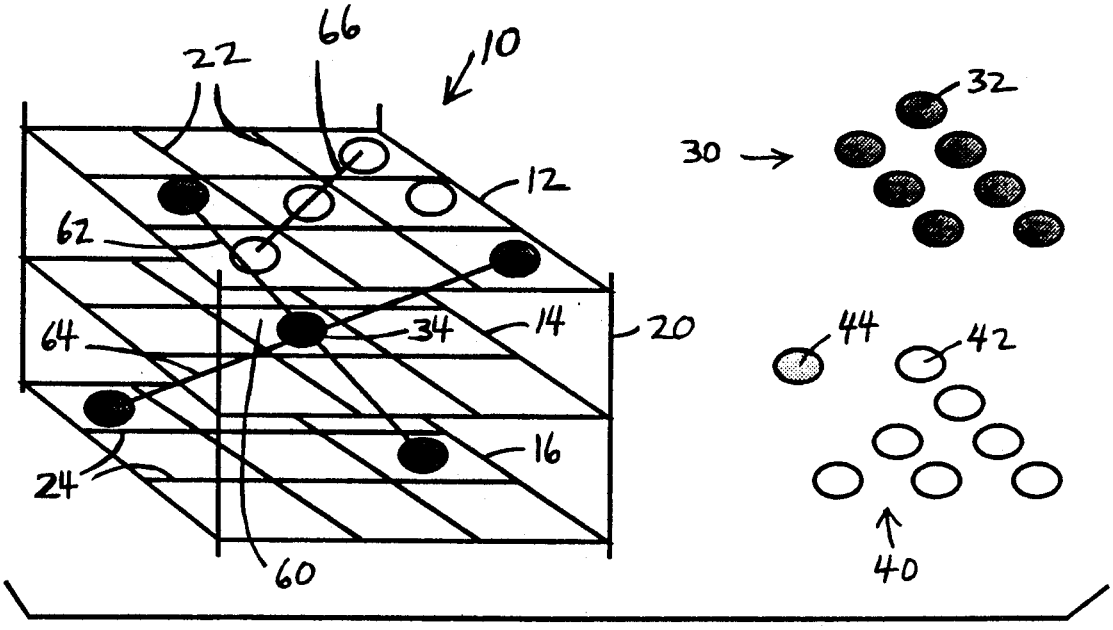
FIG. 4 is a perspective view o the board game with a star point and the game pieces including a star piece for each player according to the present invention after some play has occurred.

There is a significant advantage to playing the star piece on the star point, because more possibilities of lines of three pieces pass through the star point than any other square. FIG. 4 shows a partially completed game. Player A has played 5 pieces including player A star piece 34, which has been played on star point 60 and player A has used this to his advantage by completing two lines of three pieces, as shown by the three player A pieces in a line 62 and the three player A pieces in a line 64. Player B has played 4 pieces and completed one line of three pieces, as shown by the three player B pieces in a line 66. Player B has yet to play player B star piece 44 and when and if player B does play player B star piece 44 it won't be played on star point 60, because it is already occupied; however, player B can play player B star piece 44 on any empty square. The game, as shown in FIG. 4, is not yet complete, because neither player has completed three lines of pieces.

Figure 8:
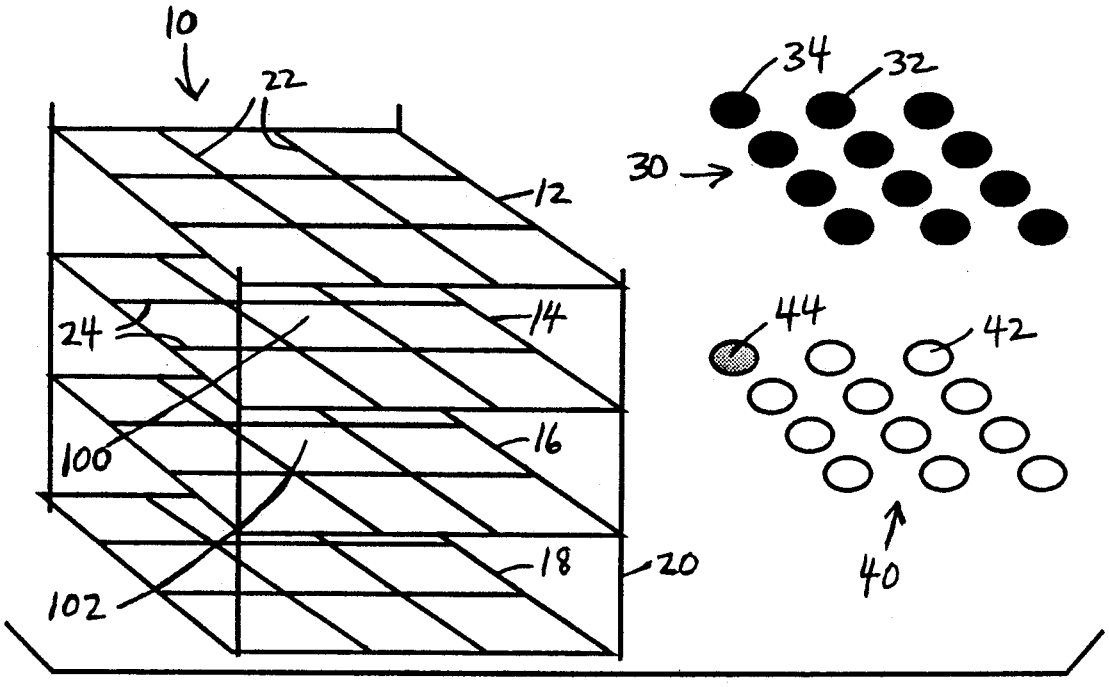
FIG. 8 is a perspective view of a board game with four boards and two star points and the game pieces including a star piece for each player according to the present invention.

If four boards are used, as shown in FIG. 8, with first board 12, second board 14, third board 16 and fourth board 18, then the number of possibilities for a player to complete the formation of three lines each with three pieces in a line increases and there are two possible star points, one which is the middle square of second board 14, which is first star point 100, and one which is the middle square Of third board 16, which is second star point 102. Again, each player would have one star piece and as shown in FIG. 8, player A has player A star piece 34 and player B has player B star piece 44. There are a number of variants of the game. One would allow any player to play his star piece on either empty star point. Another variant of the game with only two players, would assign one star point to one player and the other star point to the other player and the players could only play their star pieces on their assigned star point.

Figure 9:
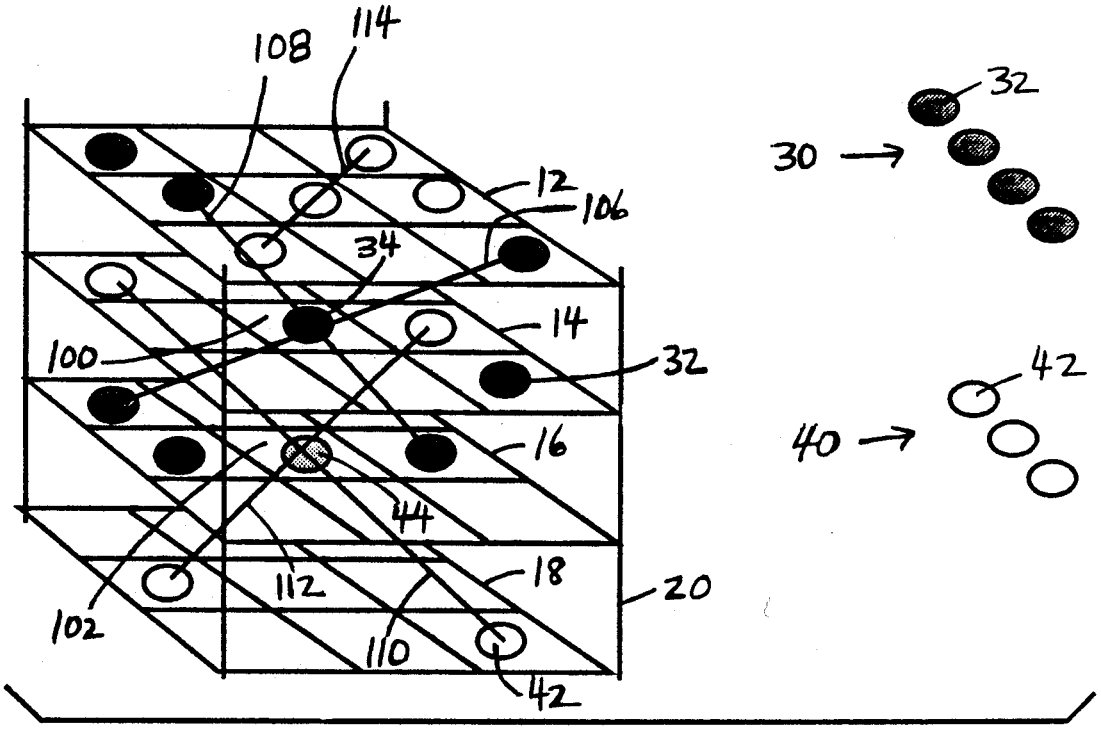
FIG. 9 is a perspective view of a board game with four boards and two star points and the game pieces including a star piece for each player according to the present invention after some play has occurred.

FIG. 9 shows a completed game played on four boards. In this game player A played 8 pieces and player B played 9 pieces and player B has won by being the first to complete three lines of three pieces, as shown by the three player B pieces in a line 110, the three player B pieces in a line 112 and the three player B pieces in a line 114. Player A completed only two lines of three pieces, as shown by the three player A pieces in a line 106 and the three player A pieces in a line 108. Both players used their star pieces with the player A star piece 34 on the first star point 100 and the player B star piece 44 on the second star point 102.

Other variants of the game are also possible, such as having more than 3 boards stacked on top of one another with each board divided into an N by N matrix of sections with N being at least 3. The game could be won by the formation of M lines with each line having L pieces placed by the winning player in a line with L being at least three and M being at least two. If star points and star pieces are used, then the N by N matrix of section must be at least 3 by 3 and N must be odd, so that a center section in the middle of the N by N matrix is formed at the $(N+1)/2$ by $(N+1)/2$ position of the matrix. The star points would be on the middle of boards of the stack of boards, but not on the top or bottom positions. The players would randomly select the pieces to play and the game is won by the winning player who is first to complete the formation of M lines on the board game wherein each line has L pieces from the set of pieces including the star piece that have been placed by the winning player in a line with L being at least three and M being at least two.

The players would select which variant of the game to play depending on the skill level of the players. The players would also draw lots or the equivalent to determine who would be the first player.

It is thought that the present invention and many of its attendant advantages will be understood from the foregoing description and it will be apparent that various changes may be made in the form, construction and arrangement of the parts thereof and in the methods used without departing from the spirit and scope of tee invention or sacrificing all of its material advantages, the forms hereinbefore described being merely a preferred or exemplary embodiments thereof.

I claim:

1. A method for playing a three dimensional board game for multiple players comprising the steps of:

providing a first board divided into a three by three matrix of nine sections;

providing a second board divided into a three by three matrix of nine sections including a middle section, and stacked vertically above said first board;

providing a third board divided into a three by three matrix of nine sections and stacked vertically above said second board;

providing a set of pieces to each of said multiple players wherein said set of pieces provided to one of said multiple players is distinguishable from said set of pieces provided to another of said multiple players;

providing a marked piece to each of said multiple players wherein said marked piece provided to one of said multiple players is distinguishable from said marked piece provided to another of said multiple players and said marked pieces are distinguishable from said sets of pieces;

a first player randomly selecting a piece to play from said set of pieces and said marked piece provided to said first player and playing said selected piece by placing said selected piece on an empty section on said first board, said second board, or said third board and wherein only said marked piece may be placed on said middle section of said second board;

a next player randomly selecting a piece to play from said set of pieces and said marked piece provided to said next player and playing said selected piece by placing said selected piece on an empty section on said first board, said second board, or said third board and wherein only said marked piece may be placed on said middle section of said second board; and each of said multiple players taking turns playing their pieces in a like fashion;

wherein said board game winner is the one of said players to be the first to complete three lines on said board game wherein each said line has three pieces from said set of pieces and said marked piece provided to said winning player; and wherein each of said lines has three pieces in a straight line of sections on said first board, said second board or said third board in any direction or across said first board, said second board and said third board in any direction.

2. A method for playing a three dimensional board game for multiple players comprising the steps of:

providing a first board divided into a three by three matrix of nine sections;

providing a second board divided into a three by three matrix of nine sections including a first middle section, and stacked vertically above said first board;

providing a third board divided into a three by three matrix of nine sections including a second middle section and stacked vertically above said second board;

providing a fourth board divided into a three by three matrix of nine sections and stacked vertically above said third board; and providing a set of pieces to each of said multiple players wherein said set of pieces provided to one of said multiple players is distinguishable form said set of pieces provided to another of said multiple players;

providing a marked piece to each of said multiple players wherein said marked piece provided to one of said multiple players is distinguishable from said marked piece provided to another of said multiple players and said marked pieces are distinguishable from said sets of pieces;

a first player randomly selecting a piece to play from said set of pieces and said marked piece provided to said first player and playing said selected piece by placing said selected piece on an empty section on said first board, said second board, said third board, or said fourth board and wherein only said marked piece may be placed on said first middle section of said second board and said second middle section of said third board;

a next player randomly selecting a piece to play from said set of pieces and said marked piece provided to said next player and playing said selected piece by placing said selected piece on an empty section on said first board, said second board, said third board, or said fourth board and wherein only said marked piece may be placed on said first middle section of said second board and said second middle section of said third board; and each of said multiple players taking turns playing their pieces in a like fashion;

wherein said board game winner is the one of said players to be the first to complete three lines on said board game wherein each said line has three pieces from said set of pieces and said marked piece provided to said winning player; and wherein each of said lines has three pieces in a straight line of sections on said first board, said second board, said third board, or said fourth board in any direction or across said first board, said second board, said third board, or said fourth board in any direction.

3. A method for playing a three dimensional board game for a first and second player comprising the steps of:

providing a first board divided into a three by three matrix of nine sections;

providing a second board divided into a three by three matrix of nine sections including a first middle section, and stacked vertically above said first board;

providing a third board divided into a three by three matrix of nine sections including a second middle section and stacked vertically above said second board;

providing a fourth board divided into a three by three matrix of nine sections and stacked vertically above said third board;

providing a set of pieces to each of said first and second players wherein said set of pieces provided to said first player is distinguishable from said set of pieces provided to said second player;

providing a marked piece to each of said first and second players wherein said marked piece provided to said first player is distinguishable form said marked piece provided to said second player and said marked pieces are distinguishable from said sets of pieces;

said first player randomly selecting a piece to play from said set of pieces and said marked piece provided to said first player and playing said selected piece by placing said selected piece on an empty section on said first board, said second board, said third board, or said fourth board and wherein only said marked piece may be placed on said first middle section of said second board and said selected piece may not be placed on said second middle section of said third board;

said second player randomly selecting a piece to play from said set of pieces and said marked piece provided to said second player and playing said selected piece by placing said selected piece on am empty section on said first board, said second board, said third board, or said fourth board and wherein only said marked piece may be placed on said second middle section of said third board and said selected piece may not be placed on said first middle section of said second board; and each of said first and second players taking turns playing their pieces in a like fashion;

wherein said board game winner is the one of said first and second players to be the first to complete three lines on said board game wherein each said line has three pieces from said set of pieces and said marked piece provided to said winning player; and wherein each of said lines has three pieces in a straight line of sections on said first board, said second board, said third board, or said fourth board in any direction or across said first board, said second board, said third board, or said fourth board in any direction.

* * * * *